US006390619B1

(12) United States Patent
Gill, Jr.

(10) Patent No.: US 6,390,619 B1
(45) Date of Patent: May 21, 2002

(54) VISION DIRECTING GOGGLE

(76) Inventor: Nolan W. Gill, Jr., 1129 Marc Anthony Dr., Baton Rouge, LA (US) 70816

( * ) Notice: Subject to any disclaimer, the term of this patent is extended or adjusted under 35 U.S.C. 154(b) by 0 days.

(21) Appl. No.: 09/552,830

(22) Filed: Apr. 20, 2000

(51) Int. Cl.[7] ..... G02C 7/10
(52) U.S. Cl. ..... 351/44; 351/155; 2/12
(58) Field of Search ..... 351/44, 45, 155, 351/156, 41; 2/10, 12

(56) References Cited

U.S. PATENT DOCUMENTS

| | | | | |
|---|---|---|---|---|
| 2,045,399 A | | 6/1936 | McMurdo | 351/45 |
| 2,694,263 A | * | 11/1954 | Francis et al. | 351/41 |
| 3,555,563 A | | 1/1971 | Grossman | 2/14 |
| 3,841,740 A | * | 10/1974 | Lacy | 351/44 |
| 5,177,510 A | | 1/1993 | Peters et al. | 351/45 |
| D375,495 S | | 11/1996 | Maclness et al. | D14/124 |
| 5,661,534 A | * | 8/1997 | Gill | 351/41 |
| 5,675,398 A | | 10/1997 | Moore | 351/45 |
| 5,682,219 A | * | 10/1997 | Kim | 351/41 |
| 5,682,220 A | | 10/1997 | Sherman et al. | 351/45 |

FOREIGN PATENT DOCUMENTS

| | | | | |
|---|---|---|---|---|
| JP | 57-164712 | * | 10/1982 | 351/45 |
| JP | 1-93717 | * | 4/1989 | 351/41 |

* cited by examiner

*Primary Examiner*—Huy Mai

(57) ABSTRACT

A vision directing goggle for directing a batter's vision during batting practice. The vision directing goggle includes a housing for directing the vision of a user. The housing is generally rectangular and has an open top side and an open bottom side. The housing has a first pair of opposing walls and a second pair of opposing walls. An elastomeric strap binds the housing to a user's head. A coupling means couples the strap member to the housing. The coupling means is affixed to an outside surface of each of the second opposing walls.

11 Claims, 3 Drawing Sheets

VISION DIRECTING GOGGLE

BACKGROUND OF THE INVENTION

1. Field of the Invention

The present invention relates to vision directing devices and more particularly pertains to a new vision directing goggle for directing a batter's vision during batting practice.

2. Description of the Prior Art

The use of vision directing devices is known in the prior art. More specifically, vision directing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,555,563; 5,675,398; 2,045,399; U.S. Pat. Des. No. 375,495; U.S. Pat. Nos. 5,682,220; 5,177,510.

While these devices fulfill their respective, particular objectives and requirements, the aforementioned patents do not disclose a new vision directing goggle. The inventive device includes a housing for directing the vision of a user. The housing is generally rectangular and has an open top side and an open bottom side. The housing has a first pair of opposing walls and a second pair of opposing walls. An elastomeric strap binds the housing to a user's head. A coupling means couples the strap member to the housing. The coupling means is affixed to an outside surface of each of the second opposing walls.

In these respects, the vision directing goggle according to the present invention substantially departs from the conventional concepts and designs of the prior art, and in so doing provides an apparatus primarily developed for the purpose of directing a batter's vision during batting practice.

SUMMARY OF THE INVENTION

In view of the foregoing disadvantages inherent in the known types of vision directing devices now present in the prior art, the present invention provides a new vision directing goggle construction wherein the same can be utilized for directing a batter's vision during batting practice.

The general purpose of the present invention, which will be described subsequently in greater detail, is to provide a new vision directing goggle apparatus and method which has many of the advantages of the vision directing devices mentioned heretofore and many novel features that result in a new vision directing goggle which is not anticipated, rendered obvious, suggested, or even implied by any of the prior art vision directing devices, either alone or in any combination thereof.

To attain this, the present invention generally comprises a housing for directing the vision of a user. The housing is generally rectangular and has an open top side and an open bottom side. The housing has a first pair of opposing walls and a second pair of opposing walls. An elastomeric strap binds the housing to a user's head. A coupling means couples the strap member to the housing. The coupling means is affixed to an outside surface of each of the second opposing walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vision directing goggle apparatus and method which has many of the advantages of the vision directing devices mentioned heretofore and many novel features that result in a new vision directing goggle which is not anticipated, rendered obvious, suggested, or even implied by any of the prior art vision directing devices, either alone or in any combination thereof.

It is another object of the present invention to provide a new vision directing goggle which may be easily and efficiently manufactured and marketed.

It is a further object of the present invention to provide a new vision directing goggle which is of a durable and reliable construction.

An even further object of the present invention is to provide a new vision directing goggle which is susceptible of a low cost of manufacture with regard to both materials and labor, and which accordingly is then susceptible of low prices of sale to the consuming public, thereby making such vision directing goggle economically available to the buying public.

Still yet another object of the present invention is to provide a new vision directing goggle which provides in the apparatuses and methods of the prior art some of the advantages thereof, while simultaneously overcoming some of the disadvantages normally associated therewith.

Still another object of the present invention is to provide a new vision directing goggle for directing a batter's vision during batting practice.

Yet another object of the present invention is to provide a new vision directing goggle which includes a housing for directing the vision of a user. The housing is generally rectangular and has an open top side and an open bottom side. The housing has a first pair of opposing walls and a second pair of opposing walls. An elastomeric strap binds the housing to a user's head. A coupling means couples the strap member to the housing. The coupling means is affixed to an outside surface of each of the second opposing walls.

Still yet another object of the present invention is to provide a new vision directing goggle that prevents outside and peripheral distractions from entering the viewing area of the batter.

Even still another object of the present invention is to provide a new vision directing goggle that keeps a batter focussed on the ball as it is pitched and enhances concentration of the batter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
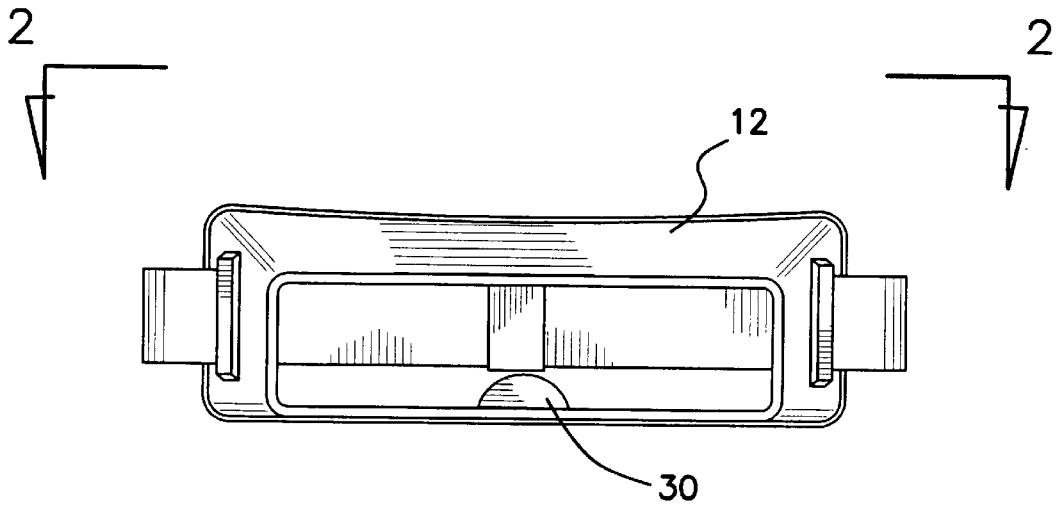
FIG. 1 is a schematic front view of a new vision directing goggle according to the present invention.
Figure 2:
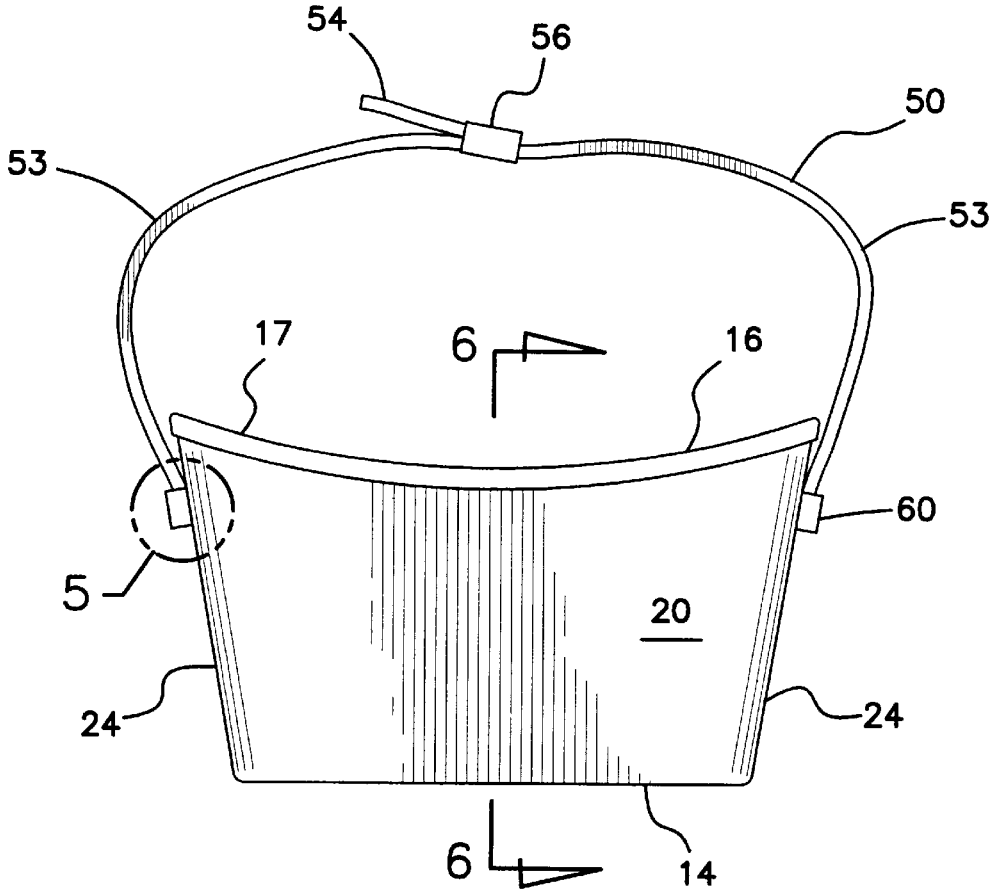
FIG. 2 is a schematic top view of the present invention.
Figure 3:
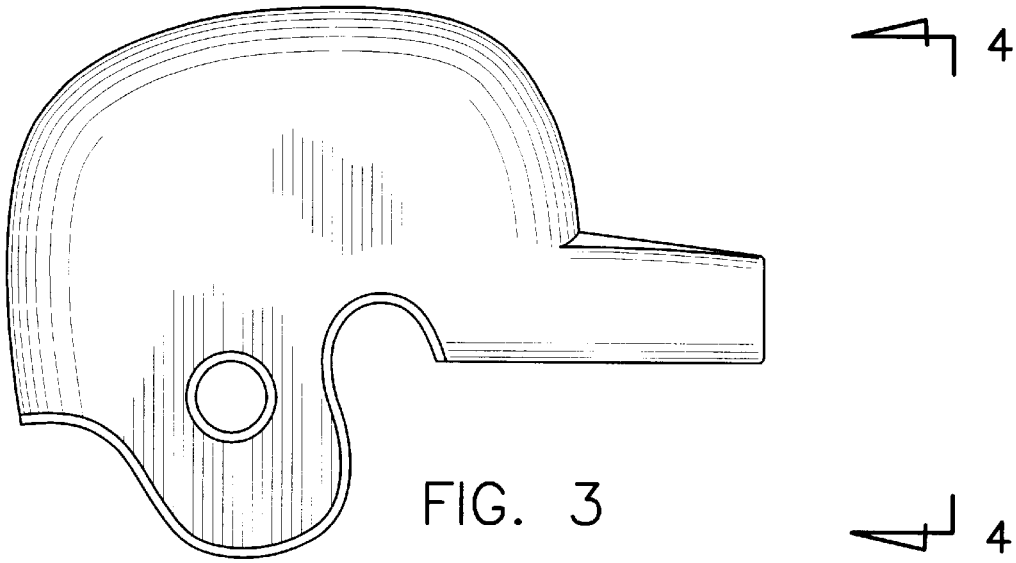
FIG. 3 is a schematic side view of the present invention.
Figure 4:
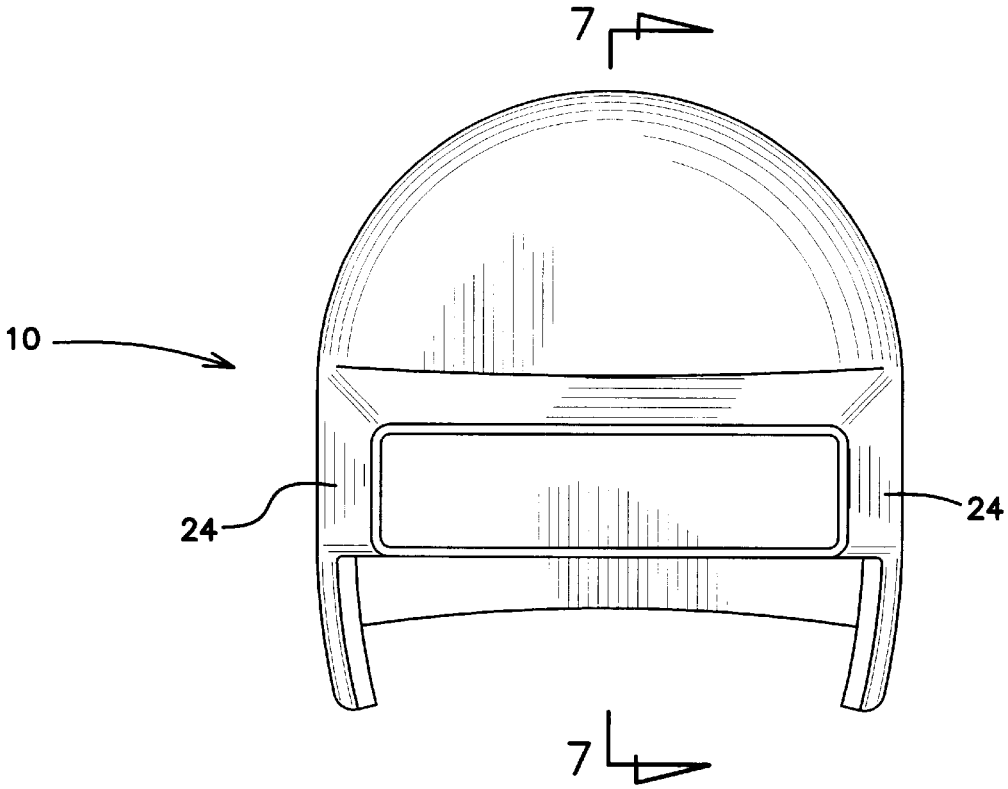
FIG. 4 is a schematic front view of the present invention.
Figure 5:
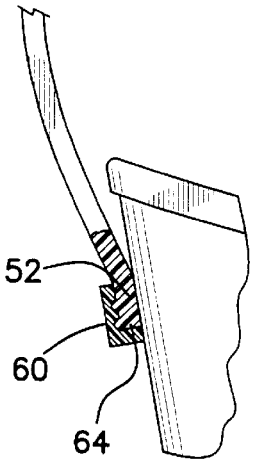
FIG. 5 is a schematic cross-sectional view of circle 5 of FIG. 2.
Figure 6:
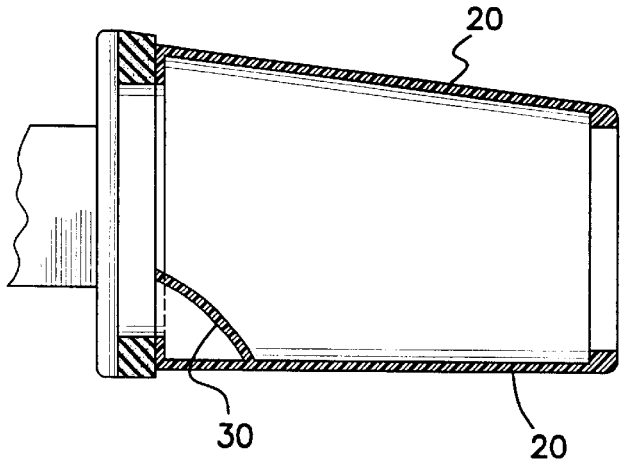
FIG. 6 is a schematic cross-sectional view taken along line 6—6 of the present invention.
Figure 7:
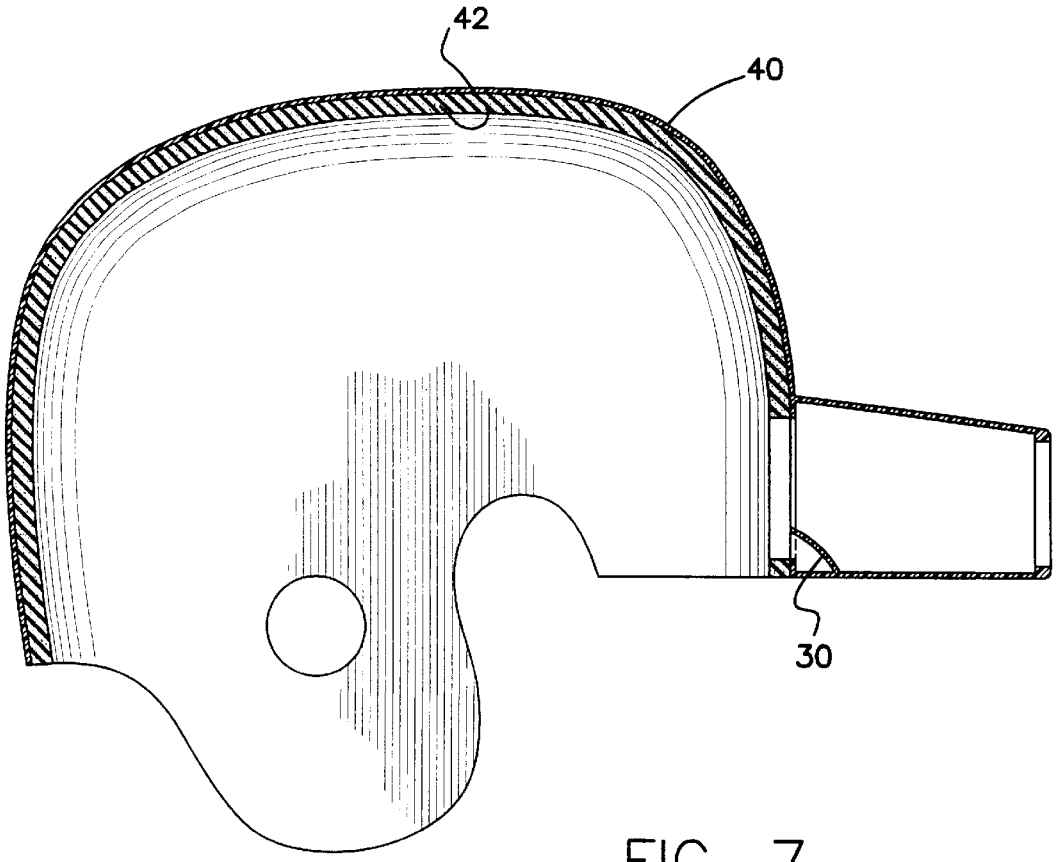
FIG. 7 is a schematic cross-sectional view taken along line 7—7 of the present invention.

With reference now to the drawings, and in particular to FIGS. 1 through 7 thereof, a new vision directing goggle embodying the principles and concepts of the present invention and generally designated by the reference numeral 10 will be described.

As best illustrated in FIGS. 1 through 7, the vision directing goggle 10 generally comprises a housing 12 for directing the vision of a user. The housing is generally rectangular and has an open top, 14 side and an open bottom side 16. In one embodiment, a transparent window made of plastic or some other transparent material is placed in the open top side 14, though this in only an option and is not necessary. The bottom side 16 has a peripheral edge 17 preferably covered with elastomeric material. The housing has a first pair of opposing walls 20 and a second pair of opposing walls 24. Each of the first pair 20 of opposing walls has a length measured from one of the second pair of opposing walls to the other of the second pair of opposing walls. Each of the second pair 24 of opposing walls has a length measured from one of the first pair 20 of opposing walls to the other of the first pair of opposing walls. The length of the first pair of opposing walls is preferably greater than twice the length of the second pair of opposing walls. The housing has a frusta-pyramidal shape such that the opening in the bottom side 16 is larger than the opening in the top side 14. Preferably, one of the first opposing walls 20 has a notch 30 therein for receiving a portion of the nose of a user to permit the housing to rest on a nose of a user. The notch extends into an interior of the housing 12 and is adjacent to the bottom side 16 of the housing. Ideally, the housing is formed from a rigid plastic.

In the preferred embodiment, a baseball helmet 40 with interior padding 42 for protecting a batter's head from being hit with a ball is fixedly coupled to the housing 12. One of the first pair of opposing wall 20 that does not have the notch therein, and each of the second pair of side walls 24, are attached to the baseball helmet 40 such that the nose of a user of the device is positionable in the notch 30 when the batting helmet is placed upon the user's head.

If the helmet is not used, a strap 50 for binding the housing to the user is employed. Preferably, the strap is made from elastomeric material such as natural or synthetic rubber. A coupling means couples the strap member to the housing. The coupling means is affixed to an outside surface of each of the second opposing walls. The coupling means comprises two protuberances 60 each of which extend from each of the second opposing 24 walls. Each of the protuberances has a well 64 therein for receiving an end 52 of the strap. Ideally, the strap is formed from two strap members. Each of said strap members have a first 52 end and a second end 54, wherein each of the first ends are coupled to the housing. Each of the second ends of the strap members are coupled together by a slidable connecting member 56 such that the length of the strap is adjustable.

The user of the device 10 places it over their head. If using the strap version, the strap 50 is fitted about the heat. If using the helmet version, the helmet 40 is placed over the head so that the housing 12 is over the eyes of the batter. The batter then takes regular batting practice with the newly restricted peripheral vision.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for maintaining alignment of a batter's vision, comprising:

a housing for directing the vision of a user, said housing being generally rectangular, said housing having an open top side and an open bottom side, said housing having a first pair of opposing walls and a second pair of opposing walls;

a strap for binding said housing to a user's head;

a coupling means for coupling said strap to said housing, said coupling means being affixed to an outside surface of each of said second opposing walls;

an elastomeric covering being attached to a peripheral bottom edge extending around the periphery of said open bottom side of said housing for protecting the user's face from the effects of the device being struck by the ball during the bating practice.

2. The device for maintaining alignment of a batter's vision as in claim 1, wherein said housing includes a notch in one of said first opposing walls for receiving a portion of the nose of a user to permit said housing to rest on a nose of a user, said notch extending into an interior of said housing, said notch being adjacent to said bottom side of said housing.

3. The device for maintaining alignment of a batter's vision as in claim 1, further comprising:

a baseball helmet for protecting a batters head from being hit with a ball, wherein said housing is fixedly coupled to said baseball helmet in a manner such that the notch may be positioned on the nose of the user when the user wears said baseball helmet.

4. The device for maintaining alignment of a batter's vision as in claim 1, wherein said strap is formed from two strap members, each of said strap members having a first end and a second end, wherein each of said first ends are coupled to said housing, each of said second ends of said strap members being coupled together by a slidable connecting member such that a length of said strap is adjustable.

5. The device for maintaining alignment of a batter's vision as in claim 1, wherein said open top side is covered by a rigid transparent member, said transparent member being formed from plastic.

6. The device for maintaining alignment of a batter's vision as in claim 1, wherein said housing has a frusta-pyramidal shape such that said bottom side is larger than said top side.

7. A device for maintaining alignment of a batter's vision, comprising:

a housing for directing the vision of a user, said housing being generally rectangular, said housing having an open top side and an open bottom side, said bottom side having a peripheral edge, said peripheral edge being covered with elastomeric material, said housing having a first pair of opposing walls and a second pair of opposing walls, one of said first opposing walls having a notch therein for receiving a portion of the nose of a user to permit said housing to rest on a nose of a user, said notch extending into an interior of said housing, said notch being adjacent to said bottom side of said housing, said housing being formed from a rigid plastic; and a baseball helmet for protecting a batters head from being hit with a ball, wherein said housing is fixedly coupled to said baseball helmet such that said notch may be positioned on the user's nose.

8. A device for maintaining alignment of a batter's vision, comprising:

a housing for directing the vision of a user, said housing being generally rectangular, said housing having an open top side and an open bottom side, said bottom side having a peripheral edge, said peripheral edge being covered with elastomeric material, said housing having a first pair of opposing walls and a second pair of opposing walls, one of said first opposing walls having a notch therein for receiving a portion of the nose of a user to permit said housing to rest on a nose of a user, said notch extending into an interior of said housing, said notch being adjacent to said bottom side of said housing, an elastomeric covering being attached to a peripheral bottom edge of said bottom side of said housing, said housing being formed from a rigid plastic;

a strap for binding said housing to a user's head, said strap being elastomeric; and a coupling means for coupling said strap to said housing, said coupling means being affixed to an outside surface of each of said second opposing walls.

9. The device for maintaining alignment of a batter's vision as in claim 8, wherein said strap is formed from two strap members, each of said strap members having a first end and a second end, wherein each of said first ends are coupled to said housing, each of said second ends of said strap members being coupled together by a slidable connecting member such that a length of said strap is adjustable.

10. The device for maintaining alignment of a batter's vision as in claim 8, wherein said housing has a frusta-pyramidal shape such that said bottom side is larger than said top side.

11. A device for maintaining alignment of a batter's vision, comprising:

a housing for directing the vision of a user, said housing being generally rectangular, said housing having an open top side and an open bottom side, said bottom side having a peripheral edge, said peripheral edge being covered with elastomeric material, said housing having a first pair of opposing walls and a second pair of opposing walls, one of said first opposing walls having a notch therein for receiving a portion of the nose of a user to permit said housing to rest on a nose of a user, said notch extending into an interior of said housing, said notch being adjacent to said bottom side of said housing, said housing having a frusta-pyramidal shape such that said bottom side is larger than said top side, an elastomeric covering being attached to a peripheral bottom edge of said bottom side of said housing; and a baseball helmet for protecting a batter's head from being hit with a ball, wherein said housing is fixedly coupled to said baseball helmet in a manner such that said notch extends into an interior of said housing, said notch may be positioned on the user's nose when the user wears said baseball helmet.

* * * * *